US012649958B2

(12) United States Patent
Xu et al.

(10) Patent No.: US 12,649,958 B2
(45) Date of Patent: Jun. 9, 2026

(54) PROCESS FOR SMELTING STEEL FOR ULTRAFINE SILICON CARBIDE SAWING WIRE

(71) Applicant: BAOSHAN IRON & STEEL CO., LTD., Shanghai (CN)

(72) Inventors: Yingtie Xu, Shanghai (CN); Zongze Huang, Shanghai (CN); Xiangjiang Liu, Shanghai (CN); Genjie Wan, Shanghai (CN); Yanfeng Qi, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 679 days.

(21) Appl. No.: 17/920,166

(22) PCT Filed: Apr. 29, 2021

(86) PCT No.: PCT/CN2021/091085
§ 371 (c)(1),
(2) Date: Oct. 20, 2022

(87) PCT Pub. No.: WO2021/223660
PCT Pub. Date: Nov. 11, 2021

(65) Prior Publication Data

US 2023/0175093 A1 Jun. 8, 2023

(30) Foreign Application Priority Data

May 6, 2020 (CN) ..... 202010373412.5

(51) Int. Cl.

| | |
|---|---|
| ***C21D 9/52*** | (2006.01) |
| ***C21C 5/52*** | (2006.01) |
| ***C21C 7/06*** | (2006.01) |
| ***C21C 7/064*** | (2006.01) |
| ***C21C 7/10*** | (2006.01) |
| ***C21D 8/06*** | (2006.01) |
| ***C22B 9/18*** | (2006.01) |
| ***C22C 33/00*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 9/525* (2013.01); *C21C 5/5241* (2013.01); *C21C 7/06* (2013.01); *C21C 7/064* (2013.01); *C21C 7/10* (2013.01); *C21D 8/06* (2013.01); *C22B 9/18* (2013.01); *C22C 33/006* (2013.01); *C22C 33/04* (2013.01); *C22C 38/001* (2013.01); *C22C 38/002* (2013.01); *C22C 38/02* (2013.01); *C22C 38/04* (2013.01); *C22C 38/06* (2013.01)

(58) Field of Classification Search
CPC ..... C22B 9/18
See application file for complete search history.

(56) References Cited

U.S. PATENT DOCUMENTS

| | | | | |
|---|---|---|---|---|
| 3,746,075 | A * | 7/1973 | Paton | C22B 9/18 373/54 |
| 4,388,112 | A * | 6/1983 | Nakashima | C21C 5/285 75/544 |
| 5,466,275 | A * | 11/1995 | More | C21C 1/02 75/10.46 |
| 2022/0243310 | A1* | 8/2022 | Hu | C22C 38/06 |

FOREIGN PATENT DOCUMENTS

| | | | |
|---|---|---|---|
| CN | 102251191 | A | 11/2011 |
| CN | 102492894 | A | 6/2012 |
| CN | 102644027 | A | 8/2012 |
| CN | 107267849 | A * | 10/2017 |
| CN | 108866433 | A | 11/2018 |

(Continued)

OTHER PUBLICATIONS

English machine translation of CN 107267849 A (Year: 2017).*
English machine translation of WO 2018/001333 A1 (Year: 2018).*
International Search Report for PCT/CN2021/091085 dated Jul. 19, 2021.
International Written Opinion for PCT/CN2021/091085 dated Jul. 19, 2021.
First Search Report for CN110230008.
EP Office Action dated Aug. 22, 2023 for EP App No. 21 799 770.9-1103.
JP Office Action dated Oct. 20, 2023 for JP App No. 2022-562387.
KR Office Action dated Dec. 7, 2023 for KR App No. 10-2022-7036956.

*Primary Examiner* — Keith D. Hendricks
*Assistant Examiner* — Joshua S Carpenter
(74) *Attorney, Agent, or Firm* — Lei Fang, Esq.; Smith Tempel Blaha LLC

(57) ABSTRACT

A process for smelting steel for ultrafine carborundum sawing wires, comprising: 1) in a vacuum induction furnace, using pure iron and low-phosphorus pig iron as raw materials to be melted into molten steel under the protection of argon; vacuumizing, smelting, and degassing; using silicon iron as a deoxidizer to adjust components of the molten steel; and casting a circular ingot in vacuum; 2) cleaning the surface of the circular ingot to produce an electrode bar; 3) remelting and smelting the electrode bar to a cylindrical electroslag ingot in an electroslag furnace, wherein the electroslag ingot comprises: $CaF_2$: 45-55%, $Al_2O_3$: 15-25%, $SiO_2$: 20-25%, $Na_2O$: 2-4%, and $K_2O$: 1-2%; 4) forging the electroslag ingot to a square billet; and 5) rolling the forged billet to a steel wire rod which comprises [C]: 0.92-1.1%, [Si]: 0.3-0.4%, [Mn]: 0.5-0.8%, [Al]<0.0008%, [N]<0.005%, [S]<0.01%, and [P]<0.015%.

8 Claims, No Drawings

(56) References Cited

FOREIGN PATENT DOCUMENTS

| | | | | | |
|---|---|---|---|---|---|
| CN | 109706385 | A | | 5/2019 | |
| CN | 109985926 | A | | 7/2019 | |
| CN | 110230008 | A | * | 9/2019 | ..... B21B 1/024 |
| CN | 112011742 | A | | 12/2020 | |
| JP | S6017713 | A | | 9/1985 | |
| WO | WO-2018001333 | A1 | * | 1/2018 | ..... B61G 9/20 |

* cited by examiner

PROCESS FOR SMELTING STEEL FOR ULTRAFINE SILICON CARBIDE SAWING WIRE

CROSS-REFERENCE TO RELATED APPLICATIONS

This application is a 371 U.S. National Phase of PCT International Application No. PCT/CN2021/091085 filed on Apr. 29, 2021, which claims priority to a Chinese Application No. 202010373412.5 filed on May 6, 2020, the contents of both are incorporated by reference herein in their entireties.

TECHNICAL FIELD

The present invention relates to a process for smelting steel for ultrafine silicon carbide sawing wires, belonging to the technical field of steel making. As used herein, carborundum is a trademark registered to Saint-Gobain Abrasives, Inc. for silicon carbide (SiC) and the terms carborundum, silicon carbide, and SiC are used herein interchangeably.

BACKGROUND

Carborundum sawing wires are mainly used to cut silicon chips, gemstones, and the like. Among them, the silicon chips are main raw materials for the photovoltaic and electronic industries. In order to improve the cutting efficiency, the carborundum sawing wires require an ultrafine specification typically having a diameter of 0.04-0.055 mm, which is thinner than human hair. The ultrafine specification puts forward strict requirements on the control of inclusions in steel. The width of all inclusions contained in the steel should be less than 10 μm, and cannot include brittle aluminum inclusions.

In the prior art, some Japanese enterprises conduct production through the process of converter-refining furnace-continuous casting-primary rolling-wire rolling. In the smelting process, inclusions are controlled mainly by strictly controlling the aluminum content of refractory materials and the denaturation treatment of inclusions to achieve inclusion refinement so that the wire rod has a deformation ability. Even so, the steel wire rod produced by this process still has the phenomenon of wire breakage during the drawing process of carborundum sawing wires, and the main cause of wire breakage is large particulate silica-alumina inclusions. Wire breakage has a great impact on the drawing production, and the wire connection time will exceed 2 hours after the wire breakage.

Those enterprises that do not have the capability to produce steel for carborundum sawing wires using converter process and electric furnace process face a main problem that they cannot control a complete absence of brittle alumina inclusions and high content of magnesia inclusions. If such inclusions are controlled by improving the refractory material, the production cost of the whole process will be greatly increased.

However, the demand for carborundum sawing wires is small, and its profit cannot offset the increase in the cost of refractory materials in the whole process. Therefore, the production of the carborundum sawing wires by the converter process or the electric furnace process cannot achieve economic benefits. In order to ensure that the carborundum sawing wire can provide enough breaking force and cut the silicon chips efficiently, the requirement for the carbon content in steel is high.

Generally, the carbon content in percentage by mass is required to be at least 0.92% or more, preferably more than 1%; in addition, the nitrogen content is required to be less than 50 ppm, and such amounts of components cannot be used in other steel grades. In the process of large-scale production of steel for carborundum sawing wires by the converter process or the electric furnace process, once the control of inclusions is not up to standard, steel in the whole batch will face the risk of being scrapped, and at the same time, the steel cannot be continuously produced in the continuous casting process. From the perspective of market demand, because of its strong durability, the consumption of the carborundum sawing wires during service is not large, for example, the market demand in China is maintained at 2,000-10,000 tons, and carborundum sawing wire manufacturers typically order no more than 30 tons each time from steel manufacturers. In this case, production with an electric furnace process or converter process of 100 tons or more will cause the problem that the production cannot be organized.

SUMMARY

In order to overcome the above-mentioned deficiencies in the prior art, the present invention provides a small-scale process for smelting steel for ultrafine carborundum sawing wires having high requirements. This process can control inclusions to produce ultrafine carborundum sawing wires without occurring wire breakage during the drawing process of the carborundum sawing wire.

The technical problems to be solved can be implemented by the following technical solutions.

Provided is a process for smelting steel for ultrafine carborundum sawing wires, of which the production process can be summarized as smelting in a vacuum induction furnace-electroslag-forging-wire rolling, and the main steps comprised in the process are as follows:

1) Melting a raw material into 2-5 tons of liquid molten steel under the protection of argon in a vacuum induction furnace with a volume of 2-5 tons, the raw material uses carbon-free pure iron and low-phosphorus pig iron having a carbon content of 3.5%-4.5% by mass and a phosphorus content of less than 0.06% by mass; then vacuumizing to perform vacuum smelting and degassing for 15-20 min under a high vacuum condition of 300 Pa or below, and performing deoxygenation with high-purity silicon iron as a deoxidizer to adjust components of the molten steel, wherein aluminum-containing deoxidizer is strictly forbidden in the deoxygenation process; and after the adjustment of the components of the molten steel, 1-2 of circular ingots are cast in vacuum, wherein each ingot has a mass of 1.5-2.5 tons, a diameter of 0.35-0.4 m and a length of 2-3 m.

In this process, the vacuum induction furnace is selected as a primary smelting furnace for its characteristics of capable of small-scale smelting and function of vacuum degassing so as to meet the denitrification requirements of the steel grade directed in the present invention; in addition, the vacuum induction furnace can also realize vacuum protective casting, which can avoid secondary oxidation and nitrogen absorption of the molten steel caused by casting under room atmosphere. Considering that the weight of the casting ingot is 1.5-2.5 tons, when casting 1-2 ingots is needed, a vacuum induction furnace with a scale of 2-5 tons needs to be selected for production; if a larger-scale induction furnace is selected, 3 or more ingots will need to be cast, which makes it difficult to realize vacuum casting. The selection of the pure iron and the pig iron as raw materials mainly because of the configuration of the carbon content of the steel grade. The pig iron contains about 4% of carbon (by mass), which can meet the requirement that the carbon content in the final molten steel is about 1% (by mass); in addition, the content of harmful residual elements in the pure iron and the pig iron is low, which can ensure that the harmful residual elements in the steel do not exceed the standard. Degassing under a high vacuum condition for 15-20 min is mainly to ensure that the denitrification can meet the requirements of the steel grade, and at the same time, dehydrogenation can also be performed to ensure that no hydrogen-induced cracks are produced. The components of the molten steel can be adjusted during the vacuum smelting process, and high-purity manganese and high-purity silicon iron are added to meet the final composition requirements of the product, wherein high-purity silicon iron refers to an iron material with a silicon content of 75-85% by mass and an aluminum content of less than 0.05% by mass. The use of high-purity silicon iron as the deoxidizer is mainly due to the high aluminum content of ordinary silicon iron, which is likely to cause the final aluminum content to exceed the standard. It is strictly forbidden to add the aluminum-containing deoxidizer, which is due to the fact that inclusions with high alumina content contained in the steel for the ultrafine carborundum wire are brittle inclusions, which will greatly damage the drawing of the carborundum sawing wires. The selection of the final ingot size is mainly based on the size requirements of the electrode bar for electroslag involved in the subsequent process.

2) Cleaning the surface of the circular ingots, and 5-10 cm of a shrinkage end is cut off to manufacture electrode bars for electroslag smelting. The "shrinkage end" mentioned in the present application refers to an end of the ingot that solidifies at the last.

3) Remelting and smelting the electrode bars as raw materials in an electroslag furnace, wherein an electroslag protecting slag comprises the following in percentage by mass: $CaF_2$: 45-55%, $Al_2O_3$: 15-25%, $SiO_2$: 20-25%, $Na_2O$: 2-4%, and $K_2O$: 1-2%, and smelting the electrode bar in the electroslag furnace into a cylindrical electroslag ingot having a diameter of 0.4-0.5 m.

During remelting and smelting in the electroslag furnace, the electrode bar, slag, and molten steel in the crystallizer are connected into an energized circuit. Under the conditions of low voltage (a voltage of 40-60V) and high current (a current of 10-20 KA), the electroslag protecting slag is used to generate local heating, so that the part in contact with the electroslag protecting slag of the top of the electrode bar gradually melts into droplets, and the large number of droplets separated from the electrode bar passes through the slag layer of the electroslag protecting slag and fall into the molten steel bath of the crystallizer, then the part in contact with the crystallizer of the molten steel bath is solidified again. During remelting and smelting in the electroslag furnace, the molten steel is filtered by the electroslag protecting slag, which can completely remove large inclusions, and the remaining inclusions are all less than 13 μm; meanwhile, the structure of the electroslag ingot obtained by remelting and smelting in the electroslag furnace is uniform and dense. After remelting and smelting in the electroslag furnace, the remaining inclusions in the steel are closer to the composition of the electroslag protecting slag in the electroslag furnace. Therefore, the present technical solution controls the composition of the electroslag protecting slag to be: $CaF_2$: 45-55%, $Al_2O_3$: 15-25%, $SiO_2$: 20-25%, $Na_2O$: 2-4%, and $K_2O$: 1-2% (based on 100% of the total mass of the electroslag protecting slag), so as to control the composition of the remaining small-particle inclusions in the molten steel also falling into this range. In the electroslag protecting slag, a part of the $CaF_2$ is converted into CaO. The inclusions in this range have the characteristics of low melting point and strong plasticizing ability, which enables sufficient deformation of the ingot along both the forging or rolling direction during the subsequent forging and rolling process, and the widths of the inclusions after deformation can all be less than 7 μm; moreover, the contact surface between the inclusions and the steel is relatively smooth, and the damage to the steel during the drawing process will be small, which will not cause wire breakage during drawing, and also ensures that the carborundum wire will not break in the cutting process of the silicon chips. The selection of the size of the electroslag ingot is mainly based on the convenience of electroslag crystallizer design and subsequent forging.

4) Forging the electroslag ingot into a forged billet for wire rolling, wherein the forged billet is a square billet having a cross section of square with a side length of 0.140-0.160 m, and the forged billet has a length of greater than 6 m and less than 14 m.

5) Rolling the forged billet into a steel wire rod having a diameter specification of 4.5-5.5 mm by the wire rolling process, wherein the steel wire rod comprises the following components in percentage by mass: [C]: 0.92-1.1%, [Si]: 0.3-0.4%, [Mn]: 0.5-0.8%, [Al]: less than 0.0008%, [N]: less than 0.005%, [S]: less than 0.01%, [P]: less than 0.015%, and the balance of iron and unavoidable impurities.

The steel wire rod produced by the present invention can finally be drawn into a carborundum sawing wire having an ultrafine specification with a diameter of 0.04-0.055 mm, which will not occur wire breakage in the drawing process, and suitable for high efficiency cutting of silicon chips, gemstones and the like.

As a further improvement of the present technical solution, in step 1), it is further required that at the end of the smelting in the vacuum induction furnace, the molten steel comprises the following elemental components in percentage by mass: [C]: 0.94-1.1%, [Si]: 0.35-0.45%, [Mn]: 0.6-0.8%, [Al]: less than 0.001%, [N]: less than 0.0045%, [S]: less than 0.01%, [P]: less than 0.015%, and the balance of iron and unavoidable impurities. Specifically, considering that silicon will be further attenuated during the electroslag process, the silicon content after the smelting in the vacuum induction furnace should be higher; moreover, since aluminum will be further attenuated during the electroslag process, [Al]<0.0008%, if required, would be difficult to achieve at this stage, so the content of Al is configured to [A1]<0.001%.

The temperature of the molten steel at the end of the smelting in the vacuum induction furnace is controlled at 1460-1500° C.; after the %, smelting in the vacuum induction furnace, argon is properly blown as a protective atmosphere, so that the pressure in the furnace is adjusted to 10000 Pa-20000 Pa, and then casting under the protective atmosphere. The protective atmosphere is, for example, but not limited to, argon, and the casting mold adopts a cast iron mold.

At the end of the smelting in the vacuum induction furnace, the content of carbon, silicon and aluminum in the molten steel will be slightly higher than that in steel after remelting and smelting in the electroslag furnace, which is mainly due to a certain attenuation of carbon, silicon and aluminum in the molten steel during remelting and smelting in the electroslag furnace. The temperature of the molten steel at the end of the smelting in the vacuum induction furnace is controlled to be 1460-1500° C., which mainly considers that the superheat degree of casting is 20-60° C., which can cast an electrode bar capable of electroslag smelting. In practical production, if only one ingot is cast, the end point temperature can be controlled close to the lower limit, that is, close to 1460° C.; if two ingots are cast, the end point temperature can be controlled close to the upper limit, that is, close to 1500° C., otherwise casting of the second ingot may not be completed. Vacuum protective casting is to prevent nitrogen absorption and secondary oxidation during the casting process.

As a further improvement of the present technical solution, in step 1), after the iron raw materials (the iron raw materials include pure iron and low-phosphorus pig iron) are completely melted, 2-5 kg of lime is added per ton of the iron raw materials for slag making, dephosphorization and desulfurization. During the smelting in the vacuum induction furnace, it is not advisable to add too much slagging material (in this technical solution, the slagging material is lime), otherwise it will cause problems such as difficulty in melting the slagging material and affecting degassing. However, since the raw materials inevitably contain sulfur and phosphorus, in order to ensure that the desulfurization and dephosphorization are sufficiently performed, a small amount of lime can be added to meet the requirements for sulfur and phosphorus contents of the product.

As a further improvement of the present technical solution, in step 3), the electroslag process needs to be carried out under a protective atmosphere including but not limited to argon; and the step of remelting and smelting in the electroslag furnace are remelting and smelting at a constant melting rate.

The step of remelting and smelting in the electroslag furnace under the protective atmosphere is mainly for preventing oxidation. If the secondary oxidation is serious, it will easily lead to serious attenuation of silicon and carbon in the molten steel due to oxidation; and at the same time, secondary oxidation of the molten steel will form more silica inclusions, which is unfavorable for the control of inclusions in the molten steel.

The present invention develops a brand-new process path, that is, through the steps of smelting in the vacuum induction furnace-electroslag-forging-wire rolling to produce the steel wire rod for the carborundum wire. The adoption of such process path is mainly based on the characteristics of low demand and high requirements for the steel for the carborundum wire, which can facilitate small-scale production of the steel for the carborundum wire, and solve the problem of excessive quantity of extra steel that cannot be utilized because of the adoption of massive converter process or an electric furnace process which produce far more weight of steel in each batch than the ordered quantity. This process completely removes large particulate inclusions and brittle inclusions through the electroslag process and can control the composition of the inclusions within the required range of inclusion plasticization, so as to achieve decontamination of all inclusions in the steel and avoid wire breakage during drawing of the carborundum wire. In this process, production may be performed at night, which can make full use of the power grid capacity during the low-peak period.

The process provided by the above technical solution has the following beneficial effects: small-scale flexible and stable production of the steel for ultrafine carborundum sawing wires can be achieved, and the widths of inclusions in the obtained final steel wire rod are all less than 7 μm, which ensures that no wire breakage due to the inclusions will occur for the steel wire rod in each drawing process of the carborundum wire.

DETAILED DESCRIPTION

The present invention provides a process for smelting steel for ultrafine carborundum sawing wires through a new steel-making process path design to produce high-end steel for the ultrafine carborundum sawing wires, which can realize the flexible and stable production of the steel for the carborundum sawing wires, and fundamentally solves the problem of wire breakage in the subsequent carborundum wire drawing process caused by poor control of inclusions.

The process includes main steps as follows:

1) Smelting a molten steel masterbatch of the steel for ultrafine carborundum sawing wires in a vacuum induction furnace by using carbon-free pure iron and low-phosphorus pig iron containing 3.5%-4.5% of carbon and less than 0.06% of phosphorus as raw materials, followed by casting into a circular ingot;
2) Manufacturing electrode bars for electroslag smelting from the circular ingot;
3) Remelting and smelting the electrode bars as raw materials in an electroslag furnace to manufacture an electroslag ingot, wherein the electroslag protecting slag including the following components in percentage by mass: $CaF_2$: 45-55%, $Al_2O_3$: 15-25%, $SiO_2$: 20-25%, $Na_2O$: 2-4%, and $K_2O$: 1-2%;
4) Forging; and
5) Rolling by wire rolling process for a steel wire rod having a diameter of 4.5-5.5 mm, wherein the steel wire rod includes the following chemical elements in percentage by mass: [C]: 0.92-1.1%, [Si]: 0.3-0.4%, [Mn]: 0.5-0.8%, [Al]: less than 0.0008%, [N]: less than 0.005%, [S]: less than 0.01%, [P]: less than 0.015%, and the balance of iron and unavoidable impurities.

The steel wire rod can be drawn into a carborundum wire having a diameter of 0.04-0.055 mm while no wire breakage caused by poor control of inclusions will occur in the drawing process.

Example 1

The process of smelting in a vacuum induction furnace-electroslag-forging-wire rolling provided by the present application is used to produce steel for carborundum sawing wires, and the main process steps thereof are as follows:

1) 1.5 tons of carbon-free pure iron rods and 0.5 tons of pig iron containing 4% of carbon (the phosphorus content of the pig iron is less than 0.06%) are used as raw materials to be melted into 2 tons of liquid molten steel under the protection of argon in a vacuum induction furnace with a capacity of 2 tons and having the function of vacuum casting. After the molten steel is completely melted, 10 kg of lime is added, and vacuumizing is performed to start vacuum smelting including degassing for 15 min under a high vacuum condition of 300 Pa or below. In the process of vacuum smelting, 8 kg of high-purity silicon iron (containing 75% of silicon) and 18 kg of pure manganese alloy are added to adjust components of the molten steel, wherein after the smelting in this step, the molten steel comprises the following chemical elements in percentage by mass: [C]: 1.05%, [Si]: 0.41% of [Si], [Mn]:

0.7%, [Al]: 0.00079% of, [N]: 0.0040%, [S]: 0.008%, [P]: 0.014%, and the balance of iron and unavoidable impurities. Then, argon is blown into the vacuum induction furnace while adjusting the pressure in the furnace to 10000 Pa or slightly higher and the temperature of the molten steel to 1465° C. and finally a circular ingot is cast under vacuum. The ingot solely has a mass of 2 tons, a diameter of 0.35 m and a length of 2.8 m.

2) The surface of the circular ingot is cleaned by grinding, and 5 cm of the ingot head with a shrinkage end is cut off to produce an electrode bar for electroslag smelting.

3) The electrode bar is used as raw material for remelting and smelting at a constant melting rate in an electroslag furnace under a protective atmosphere of argon. The electroslag protecting slag comprises the following in percentage by mass: $CaF_2$: 45%, $Al_2O_3$: 25%, $SiO_2$: 25%, $Na_2O$: 3%, and $K_2O$: 2% of. The electrode bar is smelted in the electroslag furnace into a cylindrical electroslag ingot with a diameter of 0.45 m and a length of 1.6 m.

4) The electroslag ingot is forged into a forged billet for wire rolling, wherein the forged billet is a square billet having a cross section of square with a side length of 0.140 m, and the forged billet has a length of 12.5 m.

5) The forged billet is rolled into a steel wire rod having a diameter of 4.5 mm by a wire rolling process. The steel wire rod includes the following chemical elements in percentage by mass: [C]: 1.02%, [Si]: 0.35%, [Mn]: 0.6%, [Al]: 0.0005%, [N]: 0.0048%, [S]: 0.008%, [P]: 0.014%, and the balance of iron and unavoidable impurities. Inclusions in the steel wire rod are detected as a $CaF_2$—CaO—$SiO_2$—$Al_2O_3$—$Na_2O$—$K_2O$ composite inclusion, and a $SiO_2$—$Al_2O_3$—MnO—CaO—MgO—$Na_2O$—$K_2O$ composite inclusion (the $SiO_2$ contents in both composite inclusions are greater than 50%). These two series of inclusions have good plasticity, and the widths of the inclusions are all less than 6 μm, which are harmless inclusions and will not cause wire breakage in the steel wire rod drawing process.

The steel wire rod produced in this example can finally be drawn into a carborundum master wire with a diameter of 0.05 mm while no wire breakage will occur in the drawing process and the carborundum wire can be used for high efficiency cutting of silicon chips, gemstones and the like.

Example 2

The process of smelting in a vacuum induction furnace-electroslag-forging-wire rolling provided by the present application is used to produce steel for carborundum sawing wires, and the main process steps thereof are as follows:

1) 3.75 tons of carbon-free pure iron rods and 1.25 tons of pig iron containing 3.9% of carbon (the phosphorus content of the pig iron is less than 0.06%) are used as raw materials to be melted into 5 tons of liquid molten steel under the protection of argon in a vacuum induction furnace with a capacity of 5 tons and having the function of vacuum casting. After the molten steel is completely melted, 20 kg of lime is added, and vacuumizing is performed to start vacuum smelting including degassing for 20 min under a high vacuum condition of 300 Pa or below. In the process of vacuum smelting, 20 kg of high-purity silicon iron (containing 75% of silicon) and 45 kg of pure manganese alloy are added, wherein after the smelting, the molten steel in this step, the molten steel comprises the following chemical elements in percentage by mass: [C]: 0.96%, [Si]: 0.45%, [Mn]: 0.75%, [Al]: 0.0009%, [N]: 0.0038%, [S]: 0.0095%, [P]: 0.013%, and the balance of iron and unavoidable impurities. Then, argon is blown into the vacuum induction furnace while adjusting the pressure in the furnace to 12000 Pa or slightly higher and the temperature of the molten steel to 1485° C., and finally two circular ingots are cast under vacuum, each ingot having a mass of 2.5 tons, a diameter of 0.4 m and a length of 2.6 m.

2) The surface of the circular ingot is cleaned by grinding, and 6 cm of the ingot head with a shrinkage end is cut off to produce an electrode bar for electroslag smelting.

3) The electrode bar is used as raw material for remelting and smelting at a constant melting rate in an electroslag furnace under a protective atmosphere of argon The electroslag protecting slag including in percentage by mass: $CaF_2$: 51%, $A1_2O_3$: 22%, $SiO_2$: 23%, $Na_2O$: 3%, and $K_2O$: 1%. The electrode bar is smelted in the electroslag furnace into a cylindrical electroslag ingot with a diameter of 0.5 m and a length of 1.5 m.

4) The electroslag ingot is forged into a forged billet for wire rolling, wherein the forged billet is a square billet having a cross section of square with a side length of 0.16 m, and the forged billet has a length of 12 m.

5) The forged billet is rolled into a steel wire rod having a diameter of 5 mm by a wire rolling process. The steel wire rod includes the following chemical elements in percentage by mass: [C]: 0.93%, [Si]: 0.4%, [Mn]: 0.5%, [Al]: 0.0006%, [N]: 0.0040%, [S]: 0.0095%, [P]: 0.013%, and the balance of iron and unavoidable impurities. Inclusions in the steel wire rod are detected as a $CaF_2$—CaO—$SiO_2$—$Al_2O_3$—$Na_2O$—$K_2O$ composite inclusion, and a $SiO_2$—$Al_2O_3$—MnO—CaO—MgO—$Na_2O$—$K_2O$ composite inclusion (the $SiO_2$ contents in both composite inclusions are greater than 60%). These two series of inclusions have good plasticity, and the widths of the inclusions are all less than 7 μm, which are harmless inclusions and will not cause wire breakage in the steel wire rod drawing process.

The steel wire rod produced in this example can finally be drawn into a carborundum master wire with a diameter of 0.055 mm while no wire breakage will occur in the drawing process, and the carborundum wire can be used for high efficiency cutting of silicon chips, gemstones and the like.

Example 3

The process of smelting in a vacuum induction furnace-electroslag-forging-wire rolling provided by the present application is used to produce steel for carborundum sawing wires, and the main process steps thereof are as follows:

1) 3 tons of carbon-free pure iron rods and 1 ton of pig iron containing 4.2% of carbon (the phosphorus content of the pig iron is less than 0.06%) are used as raw materials to be melted into 4 tons of liquid molten steel under the protection of argon in a vacuum induction furnace with a capacity of 4 tons and having the function of vacuum casting. After the molten steel is completely melted, 15 kg of lime is added, and vacuumizing is performed to start vacuum smelting including degassing for 18 min under a high vacuum condition of 250 Pa or below. In the process of vacuum smelting, 15 kg of high-purity silicon iron (containing 75% of silicon) and 33 kg of pure manganese alloy are added as a deoxidizer for deoxygenation, wherein after the smelting in this step, the molten steel comprises the following chemical elements in percentage by weight: [C]: 1.1%, [Si]: 0.35%, [Mn]: 0.6%, [Al]: 0.0007%, [N]: 0.0034%, [S]: 0.0099%, [P]: 0.012%, and the balance of iron and unavoidable impurities. Then, argon is blown into the vacuum induction furnace while adjusting the pressure in the furnace to 15000 Pa or slightly higher and the temperature of the molten steel to 1495° C., and finally two circular ingots are cast under vacuum, each ingot having a mass of 2 tons, a diameter of 0.38 m and a length of 2.4 m.

2) The surface of the circular ingot is cleaned by grinding, and 8 cm of the ingot head with a shrinkage end is cut off to produce an electrode bar for electroslag smelting.

3) The electrode bar is used as raw material for remelting and smelting at a constant melting rate in an electroslag furnace under a protective atmosphere of argon The electroslag protecting slag including in percentage by mass: $CaF_2$: 55%, $Al_2O_3$: 15%, $SiO_2$: 24%, $Na_2O$: 4%, and $K_2O$: 2%. The electrode bar is smelted in the electroslag furnace into a cylindrical electroslag ingot with a diameter of 0.45 m and a length of 1.5 m.

4) The electroslag ingot is forged into a forged billet for wire rolling, wherein the forged billet is a square billet having a cross section of square with a side length of 0.15 m, and the forged billet has a length of 10.3 m.

5) The forged billet is rolled into a steel wire rod having a diameter of 5.5 mm by a wire rolling process. The steel wire rod includes the following chemical elements in percentage by mass: [C]: 1.05%, [Si]: 0.3%, [Mn]: 0.5%, [Al]: 0.0005%, [N]: 0.0038%, [S]: 0.0099%, [P]: 0.012%, and the balance of iron and unavoidable impurities. Inclusions in the steel wire rod are detected as a $CaF_2$—CaO—$SiO_2$—$Al_2O_3$—$Na_2O$—$K_2O$ composite inclusion, and a $SiO_2$—$Al_2O_3$—MnO—CaO—MgO—$Na_2O$—$K_2O$ composite inclusion (the $SiO_2$ contents in both composite inclusions are greater than 50%) These two series of inclusions have good plasticity, and the widths of the inclusions are all less than 5 μm, which are harmless inclusions and will not cause wire breakage in the steel wire rod drawing process.

The steel wire rod produced in this example can finally be drawn into a carborundum master wire with a diameter of 0.04 mm while no wire breakage will occur in the drawing process, and the carborundum wire can be used for high efficiency cutting of silicon chips, gemstones and the like.

What is claimed is:

1. A process for smelting steel for silicon cardide (SiC) sawing wires, comprising the following steps of:

1) melting a raw material into liquid molten steel under the protection of argon in a vacuum induction furnace, the raw material uses carbon-free pure iron and low-phosphorus pig iron having a carbon content of 3.5%-4.5% by mass and a phosphorus content of less than 0.06% by mass; then vacuumizing to perform vacuum smelting, the vacuum smelting is performed under a condition of less than 300 Pa to degas for 15-20 min, and performing deoxygenation with silicon iron with a silicon content of 75-85% by mass and an aluminum content of less than 0.05% by mass as a deoxidizer to adjust components of the molten steel, wherein aluminum-containing deoxidizer is not used in the deoxygenation; and after the adjustment of the components of the molten steel, casting circular ingots under vacuum condition, wherein each ingot has a mass of 1500-2500 kg, a diameter of 0.35-0.4 m and a length of 2-3 m;

2) cleaning the surface of the circular ingots to manufacture electrode bars for electroslag smelting;

3) remelting and smelting the electrode bars as raw materials in an electroslag furnace, wherein an electroslag protecting slag comprises the following in percentage by mass:

$CaF_2$: 45-55%, $Al_2O_3$: 15-25%, $SiO_2$:20-25%, $Na_2O$: 2-4%, and $K_2O$: 1-2%; and smelting the electrode bar in the electroslag furnace into a cylindrical electroslag ingot having a diameter of 0.4-0.5 m, wherein the electroslag ingot has inclusions with a size of less than 13 μm;

4) forging the electroslag ingot into a forged billet for wire rolling, wherein the forged billet is a square billet having a cross section of square with a side length of 0.140-0.160 m, and the forged billet has a length of greater than 6 m; and 5) rolling the forged billet into a steel wire rod having a diameter of 4.5-5.5 mm by the wire rolling process, wherein the steel wire rod comprises the following chemical elements in percentage by weight: [C]: 0.92-1.1%, [Si]: 0.3-0.4%, [Mn]: 0.5-0.8%, [Al]: less than 0.0008%, [N]: less than 0.005%, [S]: less than 0.01%, [P]: less than 0.015%, and the balance of Fe and inevitable impurities.

2. The process for smelting steel for silicon carbide (SiC) sawing wires according to claim 1, wherein the vacuum induction furnace has a volume for containing 2000-5000 kg molten steel.

3. The process for smelting steel for silicon carbide (SiC) sawing wires according to claim 1, wherein in step 2), after cleaning the surface of the circular ingot, 5-10 cm of a shrinkage end of the ingot that solidified last is cut off.

4. The process for smelting steel for silicon carbide (SiC) sawing wires according to claim 1, wherein in the step of smelting in the vacuum induction furnace in step 1), after the smelting, the molten steel comprises the following elemental components in percentage by mass: [C]: 0.94-1.1%, [Si]: 0.35-0.45%, [Mn]: 0.6-0.8%, [Al]: less than 0.001%, [N]: less than 0.0045%, [S]: less than 0.01%, [P]: less than 0.015%, and the balance of iron and unavoidable impurities; the temperature of the molten steel is controlled at 1460-1500° C.; and after the smelting, argon is blown in as a protective atmosphere and adjusting the pressure in the vacuum induction furnace to 10000-20000 Pa, then casting under the protective atmosphere.

5. The process for smelting steel for silicon carbide (SiC) sawing wires according to claim 1, wherein in step 1), a casting mold for casting the ingot is a cast iron mold.

6. The process for smelting steel for silicon carbide (SiC) sawing wires according to claim 1, wherein in step 1), after the raw materials are completely melted, 2-5 kg of lime is added per 1000 kg of the raw materials for slag making, dephosphorization and desulfurization.

7. The process for smelting steel for silicon carbide (SiC) sawing wires according to claim 1, wherein the step 3) is carried out under a protective atmosphere, and the step of remelting and smelting in the electroslag furnace is remelting and smelting at a constant melting rate in the electroslag furnace.

8. The process for smelting steel for silicon carbide (SiC) sawing wires according to claim 4, wherein in step 1), a casting mold for casting the ingot is a cast iron mold.

* * * * *